United States Patent [19]

Goulter

[11] 4,103,777

[45] Aug. 1, 1978

[54] VIBRATING DISC SEPARATOR

[76] Inventor: Victor Harold Goulter, via Tabulam, Jackson's Flat, N.S.W., 2470, Australia

[21] Appl. No.: 607,704

[22] Filed: Aug. 25, 1975

[30] Foreign Application Priority Data

Oct. 15, 1974 [AU] Australia ..... 367/74

[51] Int. Cl.[2] ..... B03B 5/04; B03B 7/00

[52] U.S. Cl. ..... 209/43; 209/438; 209/500; 209/504

[58] Field of Search ..... 209/14, 42, 43, 435, 209/437, 438, 440, 443, 444, 459, 471, 477, 479, 500, 503, 504, 506, 508, 505, 436, 439; 259/DIG. 43

[56] References Cited

U.S. PATENT DOCUMENTS

| | | | |
|---|---|---|---|
| 406,635 | 7/1889 | Dickinson | 209/471 |
| 658,947 | 10/1900 | Goyne et al. | 209/479 |
| 676,419 | 6/1901 | Carter | 209/14 |
| 2,323,557 | 7/1943 | McLean | 209/44 |
| 2,329,781 | 9/1943 | Overhultz | 209/438 |
| 2,875,988 | 3/1959 | Wysong | 259/DIG. 43 |

*Primary Examiner*—Frank W. Lutter
*Assistant Examiner*—Ralph J. Hill
*Attorney, Agent, or Firm*—Stevens, Davis, Miller & Mosher

[57] ABSTRACT

A separator for mixed solid particulate materials such as gold or heavy minerals which are dispersed in a host material such as sand. A circular disc has a slanting surface with a plurality of riffles for catching the heavy materials. The riffles are defined by a plurality of annular baffles each having short radial walls projecting toward the center of the disc. A water turbine having off-center weights is used to vibrate the disc.

9 Claims, 7 Drawing Figures

VIBRATING DISC SEPARATOR

This invention relates to the separation of heavy solid materials from lighter solid materials, and more particularly to a method and apparatus for separating gold and other heavy minerals from sand or other host material.

Attempts have been made to construct small or portable gold separation units, but these have suffered from the disadvantage that they were not effective in handling the large quantities of material necessary for treatment when only small amounts of gold were present.

It is an object of the invention to overcome the above and other disadvantages.

According to the invention therefore, in one of its aspects, a separator for mixed solid particulate materials comprises, in combination, a laminar or sloped member having a raised input region for said materials and a relatively lower output region, said member having a plurality of riffles disposed upon the upper surface thereof, and means for oscillating said member while admitting irrigating liquid near said input region, whereby said riffles progressively capture and retain a substantial proportion of the heavier components of said materials, while a substantial proportion of the lighter components of said materials is progressively washed clear of said member at said output region.

Certain embodiments of the invention defined in the preceding paragraph will now be described with reference to the accompanying drawings, in which similar references indicate corresponding parts.

DETAILED DESCRIPTION OF THE DRAWINGS

Figure 1:
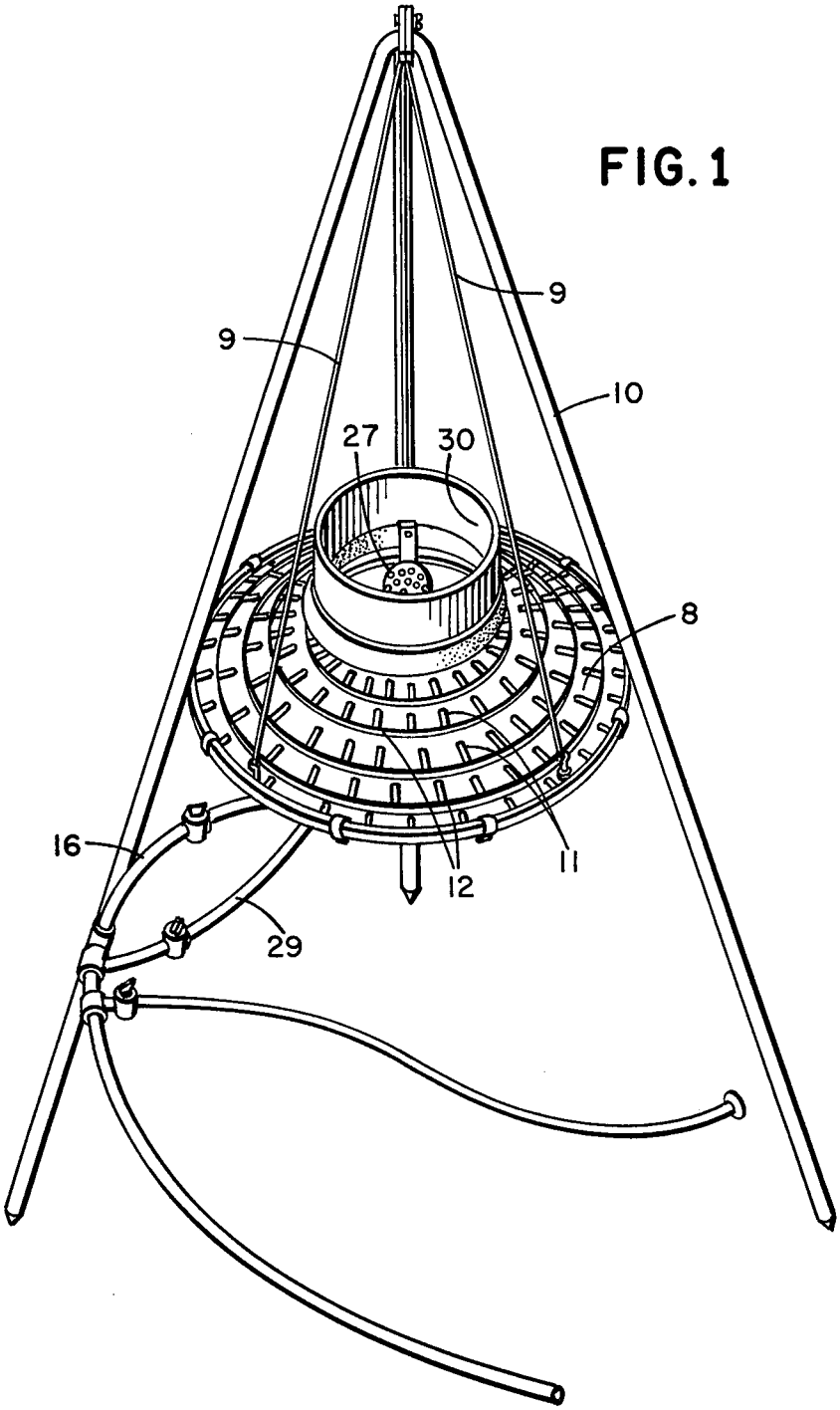
FIG. 1 shows, in perspective, a view of a separating disc unit suspended from a tripod.
Figure 2:
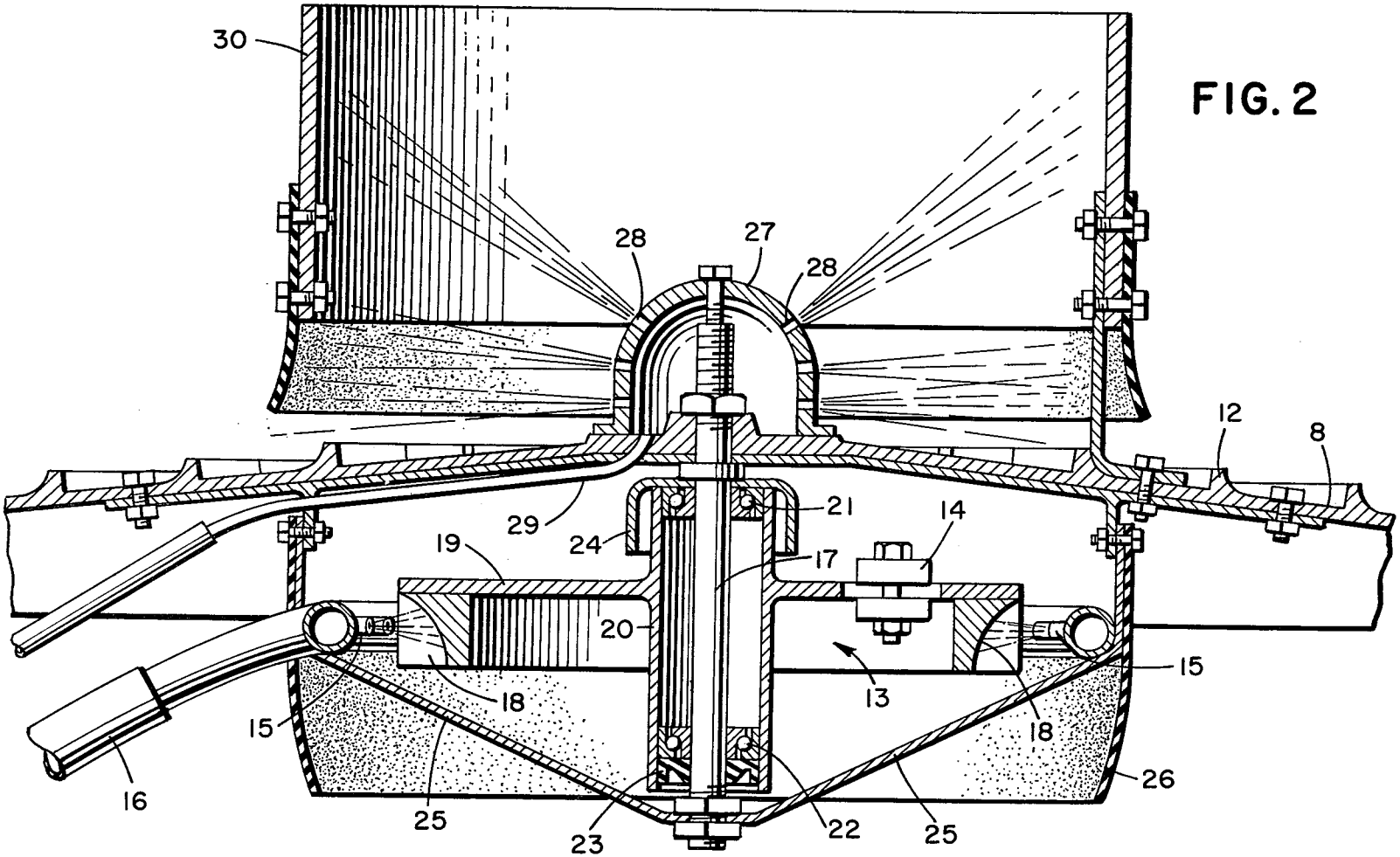
FIG. 2 shows, in front elevation and partly in section, the separating disc unit of FIG. 1.
Figure 3:
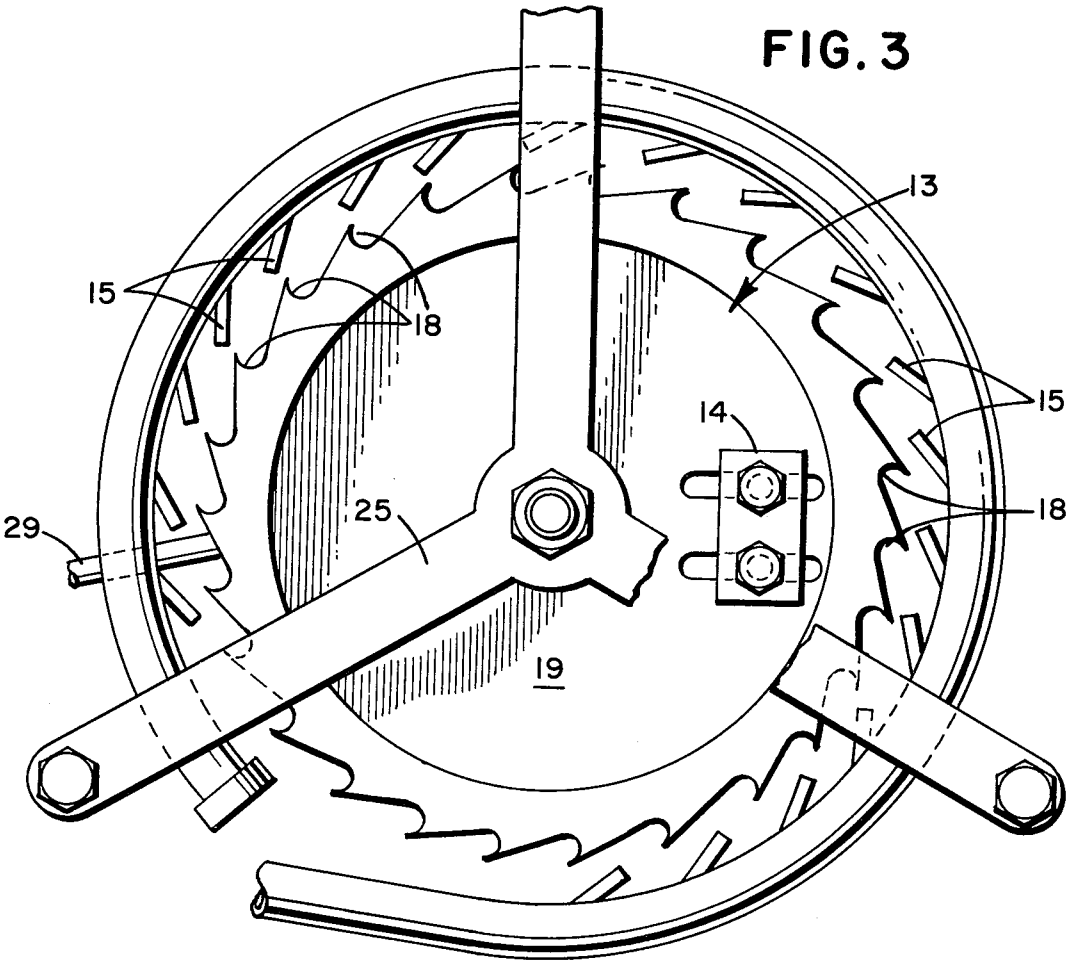
FIG. 3 shows, in plan view from below, the turbine drive arrangement of said unit.
Figure 4:
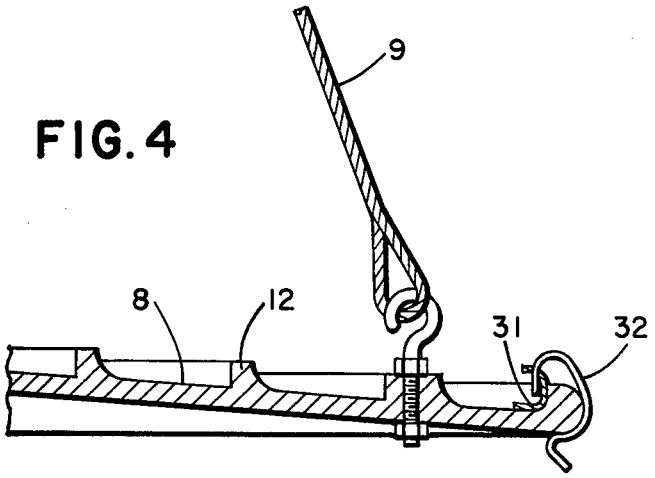
FIG. 4 shows in front elevation, and partly in section, a detail of the suspension means for said unit.
Figure 5:
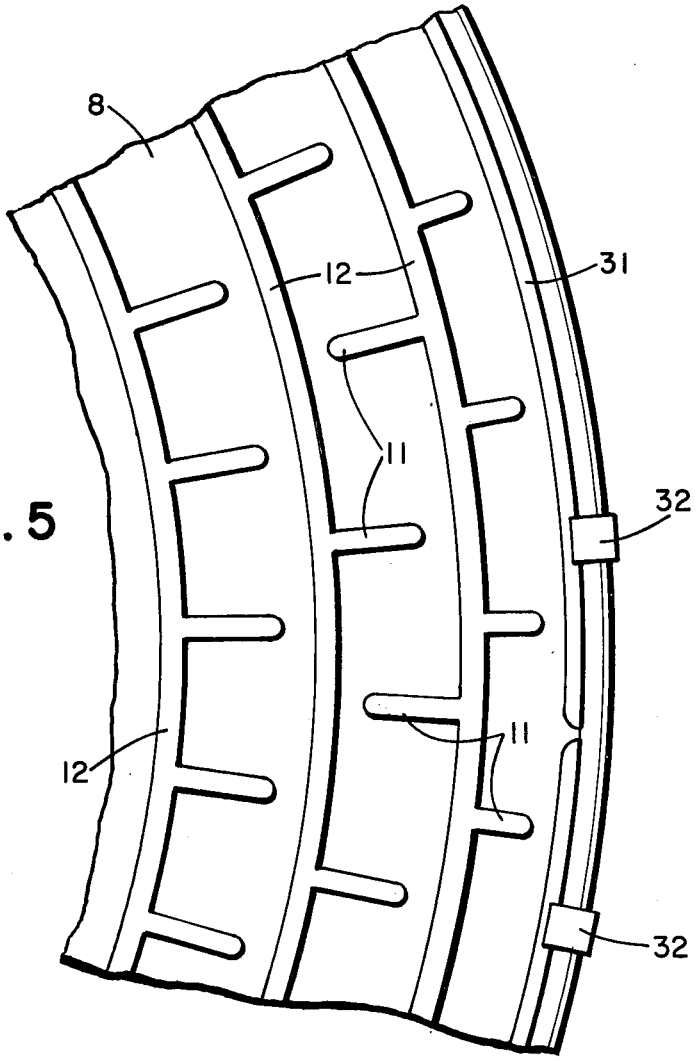
FIG. 5 shows, in plan view, a detail of the upper surface of the disc.

Upon referring to FIGS. 1 to 5 of the drawings it will be seen that a separating disc 8 of frusto-conical shape is suspended in a substantially horizontal attitude by ropes such as 9 from a tripod 10. The disc 8 may, of course, have other suitable shapes such as flat, convex or concave, or a combination of such shapes. It may also be formed from any suitable rigid material such as fibreglass, vulcanized rubber, pressed or cast aluminium or aluminium alloy sheeting, or timber. Preferably the upper surface of said disc is roughened, for example, by embedding mineral sand therein.

Said upper surface is provided with a large number of riffles comprising radial walls such as 11 and circumferential baffles such as 12. Alternatively said riffles may take the form of grooves, indentations or other irregularities.

If desired, a suitable sieve or mesh or grid (not shown) may be used to assist in the separation of heavy material from lighter material by dividing the coarse from the fines.

The disc 8 is supported from the ropes 9, or from any alternative flexible suspension means, in such a manner that said disc is permitted a degree of free movement when an external vibrator or shaker is connected thereto. One such vibrator consists of a turbine wheel 13 having eccentrically mounted weights 14, and operating jets such as 15 supplied with water or other liquid from a flexible hose 16. The weights 14 are adjustable in position towards or away from the shaft 17. The wheel 13 comprises a ring of vanes such as 18 attached to a disc 19 fastened by welding or otherwise to a tube 20 which is supported upon upper bearing 21 and lower bearing 22, each of which may consist of a ball race. The bearing 22 is preferably protected by a seal 23, and the bearing 21 is preferably protected by a water shield 24. A support spider 25 anchors the shaft 17 in a stationary manner at the lower end of said shaft, and also positions the ring of jets such as 15 with respect to the wheel 13. A shroud 26 prevents water from splashing upon an operator.

In an alternative arrangement (not shown) said jets 15 may be replaced by a single larger jet which would be less prone to becoming blocked, but which would be somewhat less efficient.

The weights 14 are adjustable for the purpose of varying the degree of oscillation imparted to the disc 8 when said turbine wheel 13 is put in motion by the jet or jets, supplied from a conventional motor/pump unit.

A dome 27 may be mounted above and with respect to the disc 8, and is drilled or otherwise perforated with a plurality of small holes such as 28 to form dissolving jets to assist in the removal of unwanted clay, dust or the like from material admitted to the disc for treatment. A pipe 29 may admit water to the interior of the dome 27 from the same supply source as that for the pipe 16. A suitable screen 30 surrounds the dome 27 and is attached thereto, to protect an operator from water emitted by the jets 28.

In use, the invention causes mixed material such as ore admitted near the center of the disc 8 to be separated into mineral-bearing components which are trapped by the riffles, and waste material which progressively passes out over the edge of the disc, under the combined action of water flow and disc vibration. By pulling on the ropes 9 or otherwise, the disc may then be tilted into a nearly vertical position in which "cleaning off" may occur, to recover the accumulated material from the riffles.

In tests leading to the present invention the separation of gold, tin, mineral sands, garnets and sapphires has been successful. The invention is also applicable to the cleaning of opals by removing the clay and other unwanted material from the hard lumps which contain the opals.

It will be seen that the invention is superior to a conventional sluice box, wherein the riffles are usually all of the same length. In such devices the larger rocks of an ore mixture are usually not carried along when the water velocity increases at a point of arrest of such rocks. By contrast, the invention ensures that the length of the riffles increases towards the outer edge of the disc, and hence the water does not speed up when passing a temporarily arrested rock. Consequently there is no need to remove large rocks from the disc from time to time by a separate manual or other process, because said rocks will eventually pass on and fall from the edge of the disc, thereby saving the cost of surveillance and-/or labor. Such action could, however, be taken if a higher output is required.

If desired, a copper amalgam channel 31 may be disposed around the outermost riffle consisting of one of said circumferential baffles 12. Said channel may be made in sections and attached by means of a series of clamps such as 32 so that the channel may be removed easily for cleaning or for the re-application of mercury. Small amounts of mercury may be placed in said channel, and also in any one of the indentations or grooves formed throughout the disc by the riffles. It has been found, in tests leading to the invention, that such mercury is not lost as a result of the oscillations of the disc, and is effective in amalgamating in known manner with any gold which may be present.

Figure 6:
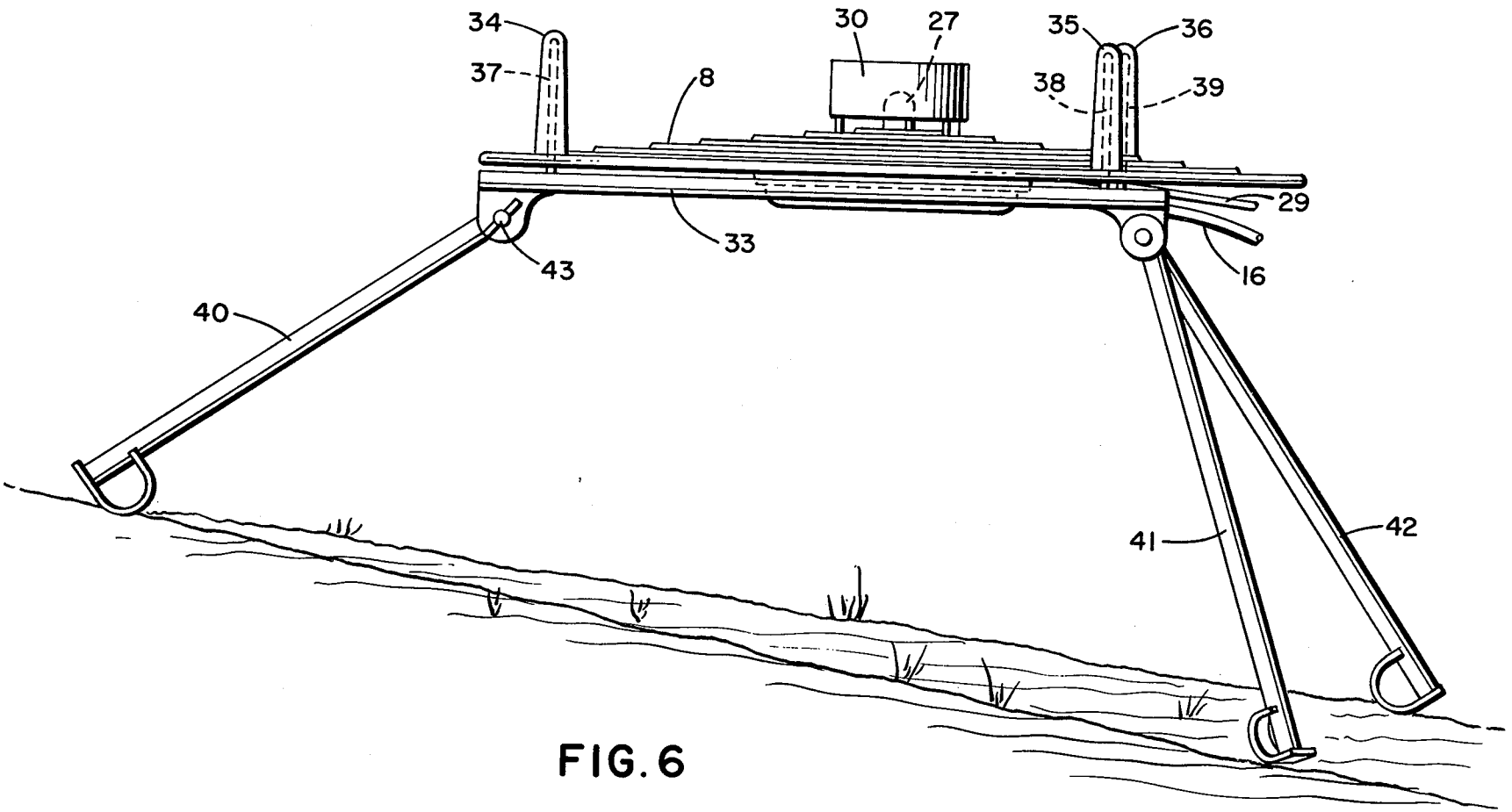
FIG. 6 shows, in front elevation, a modified form of the invention.
Figure 7:
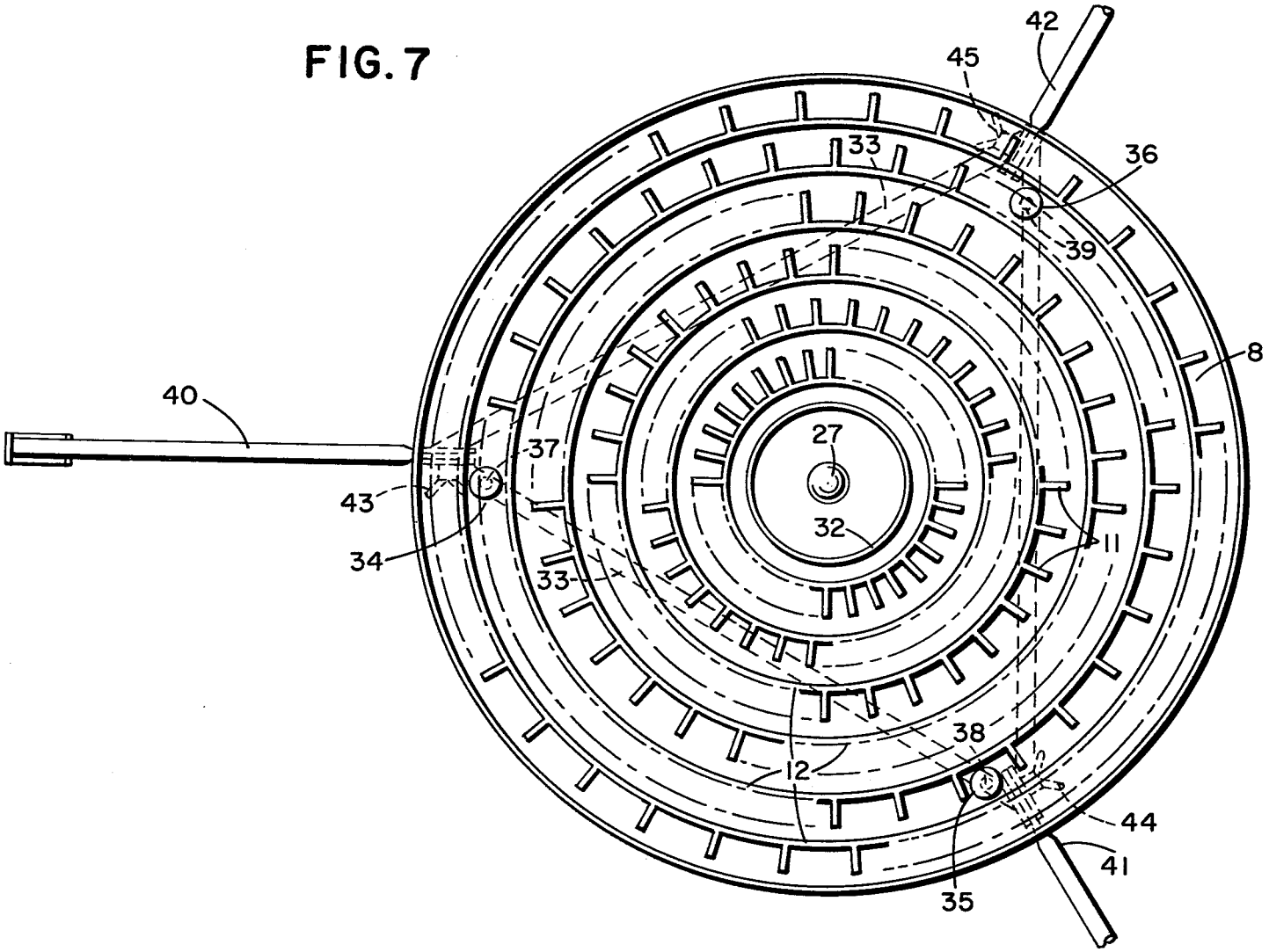
FIG. 7 shows, in plan view, the apparatus of FIG. 6.

In a modification of the invention, shown in FIGS. 6 and 7, the disc 8 is provided with an alternative support means consisting of the stand 33. Three flexible cups 34, 35 and 36 are fitted through the disc, and the latter is then located over the three respective location pins 37, 38 and 39 on said stand. Sufficient room is allowed between each pin and the inside of its respective cup to permit the oscillation or vibration of the disc by the water turbine as above described.

Whereas in the first-mentioned embodiment of the invention the disc 8 is raised on one side until it is in an almost vertical position for cleaning off, the present modification allows the disc to be lifted bodily off the stand 33 for cleaning. Also the stand 33 is designed to permit easy adjustment of the legs 40, 41 and 42 for uneven ground, so that the disc 8 will remain substantially horizontal in use.

The purpose of this modification is the provision of a portable unit which may be made sufficiently small for one person to carry the complete unit, including a small motor/pump. Alternatively the unit could be carried easily on a very small vehicle such as a motorcycle.

The triangular shaped stand 33 is made from six components which are held together and adjusted by the three wing nuts 43, 44 and 45. Each side rail of the stand has one location pin attached by welding or otherwise as shown. The stand may be made from any suitable rigid material such as aluminium or one of its alloys. The legs 40, 41 and 42 may be folded towards the center of the stand for convenient stowing or transport, or the entire unit may be readily dismantled and re-erected at a different site.

The claims defining the invention are as follows:

1. A separator for mixed solid particulate materials comprising, in combination, a generally circular member having a raised central input region for said materials and a lower output region along the outer edge, said member having a plurality of riffles disposed upon the upper surface thereof and defined by a plurality of annular baffles, each having a plurality of short radially extending walls with the length of the riffles being greater near the edge than near the center, means for vibrating said member, means for admitting irrigating liquid near said input region, the arrangement being such that said riffles progressively capture and retain a substantial proportion of the heavier components of said materials, while a substantial proportion of the lighter components of said materials is progressively washed clear of said member at said output region.

2. A separator as claimed in claim 1, wherein said means for oscillating said disc comprises a water turbine having an eccentric weight adjustable with respect to the rotation axis of said turbine.

3. A separator as claimed in claim 1, wherein said member is disc shaped in horizontal section, with said input region lying near the center of said disc, the outer edge of which comprises said output region.

4. A separator as claimed in claim 3, wherein said disc is suspended in a substantially horizontal attitude from flexible support means attached near the periphery of said disc.

5. A separator as claimed in claim 3, wherein said disc is suspended via flexible cups coextensive with said disc, said cups being held gravitationally in relation to respective upstanding pins mounted upon a support stand having adjustable legs adapted to conform with uneven ground.

6. A separator as claimed in claim 1, wherein said member is frusto-conical in shape with a radially outward downward slope.

7. A separator as claimed in claim 6, wherein means for admitting said irrigating liquid is mounted above and with respect to the frustum.

8. A separator as claimed in claim 6, wherein the periphery of said member is provided with a demountable amalgam channel adapted to hold mercury therein.

9. The separator of claim 1 in which the length of the riffles increases toward the output region.

* * * * *